US006319212B1

(12) United States Patent
Müller et al.

(10) Patent No.: US 6,319,212 B1
(45) Date of Patent: Nov. 20, 2001

(54) VACUUM MASSAGING APPARATUS HAVING A PUMP AND HAVING NOISE REDUCTION MEANS IN THE PUMP AREA

(75) Inventors: Ingo Müller, Klagenfurt; Arthur Putzer, Eisenkappel, both of (AT); Frans Van Der Vinne, Drachten (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/504,092

(22) Filed: Feb. 14, 2000

(30) Foreign Application Priority Data

Feb. 18, 1999 (EP) ..... 99890062

(51) Int. Cl.[7] ..... A61H 15/00

(52) U.S. Cl. ..... 601/7; 601/6; 601/122; 601/126; 601/125; 601/133

(58) Field of Search ..... 601/6–9, 122, 601/125, 126, 133; 604/313, 314, 315

(56) References Cited

U.S. PATENT DOCUMENTS 4,970,753 * 11/1990 Herron, Jr. ..... 15/326
6,017,320 * 1/2000 Bleeker et al. ..... 601/125

FOREIGN PATENT DOCUMENTS

98/02123 1/1998 (WO) ..... A61H/15/00

* cited by examiner

*Primary Examiner*—Michael A. Brown
*Assistant Examiner*—Benjamin K. Koo
(74) *Attorney, Agent, or Firm*—Ernestine C. Bartlett

(57) ABSTRACT a massaging apparatus (1) having a suction chamber (17) and having a pump (41) for the generation of a partial vacuum in the suction chamber (17) the pump (41) is mounted on a support (9) of the massaging apparatus (1) with the aid of elastic mounts (64, 65) and first noise reduction means (70) have been provided upstream of an inlet (50) of the pump (41) and second noise reduction means (71) have been provided downstream of an outlet (51) of the pump (41).

10 Claims, 3 Drawing Sheets

VACUUM MASSAGING APPARATUS HAVING A PUMP AND HAVING NOISE REDUCTION MEANS IN THE PUMP AREA

BACKGROUND OF THE INVENTION

The invention relates to a vacuum massaging apparatus as defined in the opening part of Claim 1.

Such a massaging apparatus is known from the patent document WO 98/02123 A1. In the know massaging apparatus the pump is formed by a diaphragm pump whose inlet is connected directly to a coupling portion of the suction chamber of the known massaging apparatus by a connecting tube and whose outlet opens directly into the air volume inside the housing of the massaging apparatus. It has appeared that some of the users of the known massaging apparatus consider the noise generated by such a massaging apparatus to be too loud and, consequently, annoying. Tests of the known massaging apparatus have revealed that this undesired noise generation mainly originates from the pump area and from the intake area and delivery area of the pump.

SUMMARY OF THE INVENTION

It is an object of the invention to improve a massaging apparatus of the type defined in the opening paragraph by simple means and to provide an improved massaging apparatus in which the noise generation has been reduced significantly in comparison with the known massaging apparatus.

According to the invention, in order to achieve this object, a massaging apparatus of the type defined in the opening paragraph has the characteristic features defined in the characterizing part of Claim 1.

The characteristic features provided in accordance with the invention result in a significant noise reduction for the massaging apparatus in accordance with the invention in comparison with the known massaging apparatus. This noise reduction is of the order of approximately 10 dB. In tests that were carried out this noise reduction was judged to be a significant improvement.

In a massaging apparatus in accordance with the invention the first noise reduction means may be formed by a vessel included in the air transfer duct between the suction chamber and the inlet of the pump, which vessel contains a sound-absorbing material, for example a foam plastic, felt, or similar materials. However, it has proved to be particularly advantageous to provide the characteristic features defined in Claim 2 because this results in a particularly simple and low-cost construction.

In a massaging apparatus in accordance with the invention it has further proved to be advantageous to provide the characteristic features defined in Claim 3 because this results in a very good trade-off between a compensation vessel of minimal size and an optimum noise reduction. In this respect it has proved to be particularly advantageous to provide the characteristic features defined in Claim 4.

It has further proved to be very advantageous to provide the characteristic features defined in Claim 5 in a massaging apparatus in accordance with the invention because this results in a particularly simple and compact but also cheap and reliable construction. It has further proved to be very advantageous to provide the characteristic features defined in Claim 6, 7, 8or 9 in such a massaging apparatus in accordance with the invention because this enables a particularly good noise reduction in the area of the pump outlet to be achieved.

It has proved to be very advantageous to provide the characteristic features defined in Claim 10 in a massaging apparatus in accordance with the invention having a cover in the area of the pump outlet because it is thus possible to obtain a distinct reduction of the noise caused by the oscillatory diaphragm of the pump in the form of a diaphragm pump.

The afore-mentioned as well as further aspects of the invention will be apparent from the embodiment described hereinafter by way of example and will be elucidated with reference to this example.

BRIEF DESCRIPTION OF DRAWINGS

The invention will now be described in more detail with reference to the drawings, which show an embodiment given by way of example, to which the invention is not limited.

DESCRIPTION OF THE PREFERRED EMBODIMENTS

Figure 1:
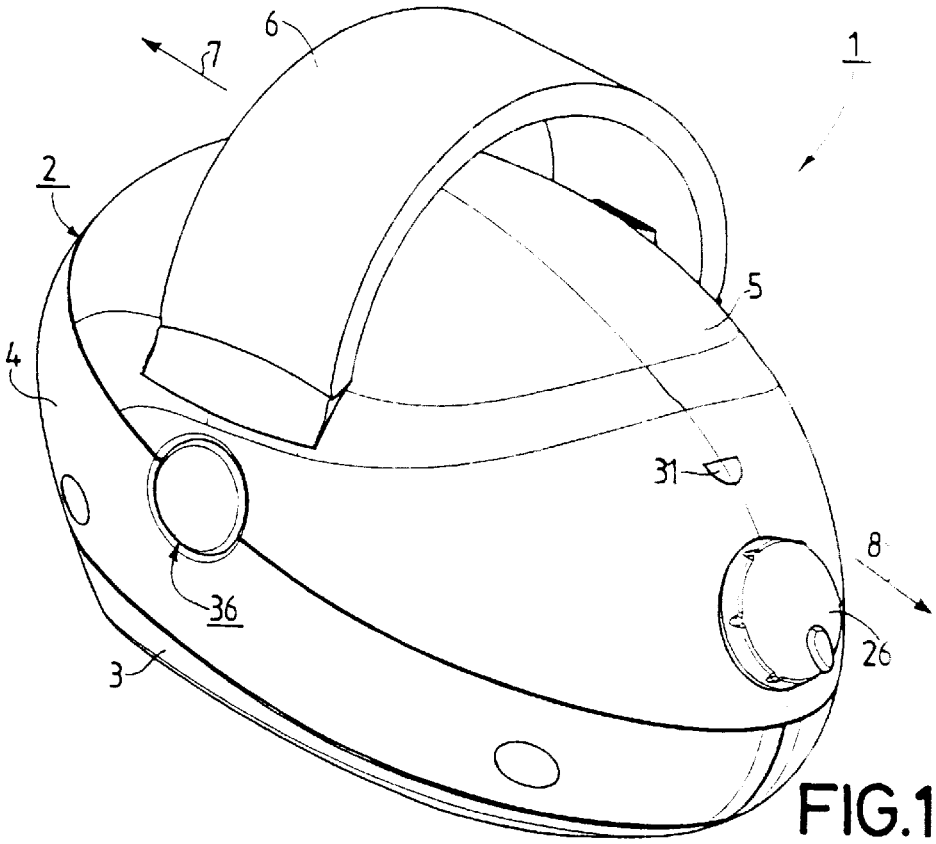
FIG. 1 shows a massaging apparatus in accordance with an embodiment of the invention in an oblique top view.

FIG. 1 shows a massaging apparatus 1 having a housing 2. The housing 2 comprises a lower housing section 3, a central housing section 4 and an upper housing section 5. The upper housing section 5 has a loop-shaped elastically flexible handle member 6 connected to it. A user can insert a hand, i.e. the four fingers and the back of a hand, between the upper housing section 5 and the handle member 6, thus enabling the massaging apparatus 1 to be held firmly and to be passed over the skin of a user in the operating direction indicated by an arrow 8.

The housing 2 further accommodates a support 9, which serves to carry and mount various parts of the massaging apparatus 1.

The massaging apparatus 1 two massaging rollers 12 and 13 which can be driven so as to rotate in directions indicated by the arrows 10 and 11. The two massaging rollers 12 and 13 are mounted on the support 9 so as to be rotatable. A motor 14 for driving the two massaging rollers 12 and 13 is mounted on a transmission casing 15 which is connected to the support 9. The transmission box 15 accommodates a gear-wheel transmission 16 which comprises a plurality of gear wheels and via which the two massaging rollers 12 and 13 can be driven by means of the motor 14.

Figure 2:
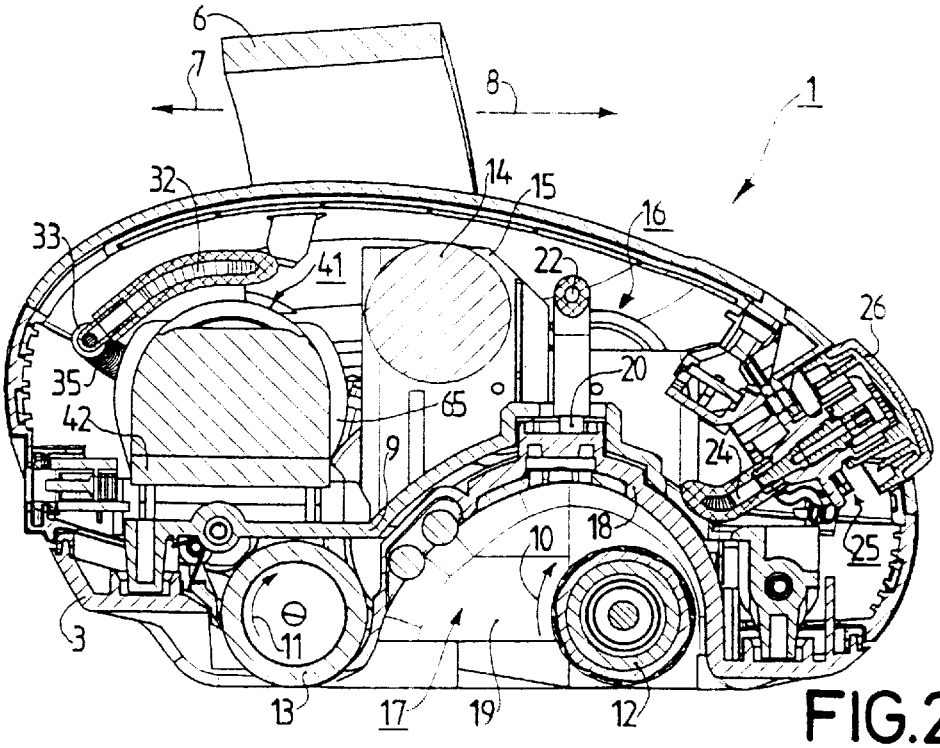
FIG. 2 shows the massaging apparatus of FIG. 1 in a sectional view taken parallel to the longitudinal direction of this apparatus.

In the area of the lower housing section 3 the massaging apparatus 1 has a suction chamber 17 bounded by an arcuate upper wall at the top and laterally bounded by two curved side walls 19. of which only one side wall 19 is visible in FIG. 2. As is apparent from FIG. 2, the forward massaging roller 12, as viewed in the operating direction 8, is situated inside the suction chamber 17 and the rearward massaging roller 13, as viewed in the operating direction 8, is situated outside the suction chamber 17.

Figure 3:
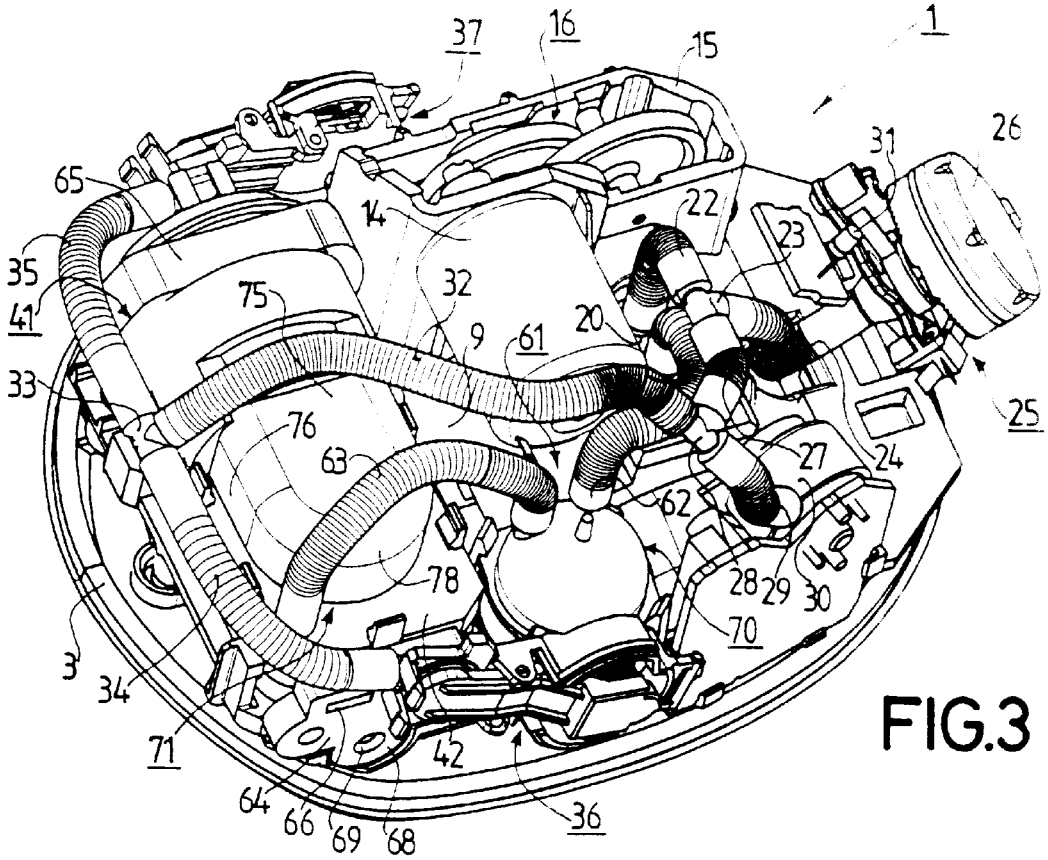
FIG. 3 shows the massaging apparatus of FIGS. 1 and 2 in an oblique top view in which only a lower housing part is shown and the other housing parts are not shown.
Figure 4:
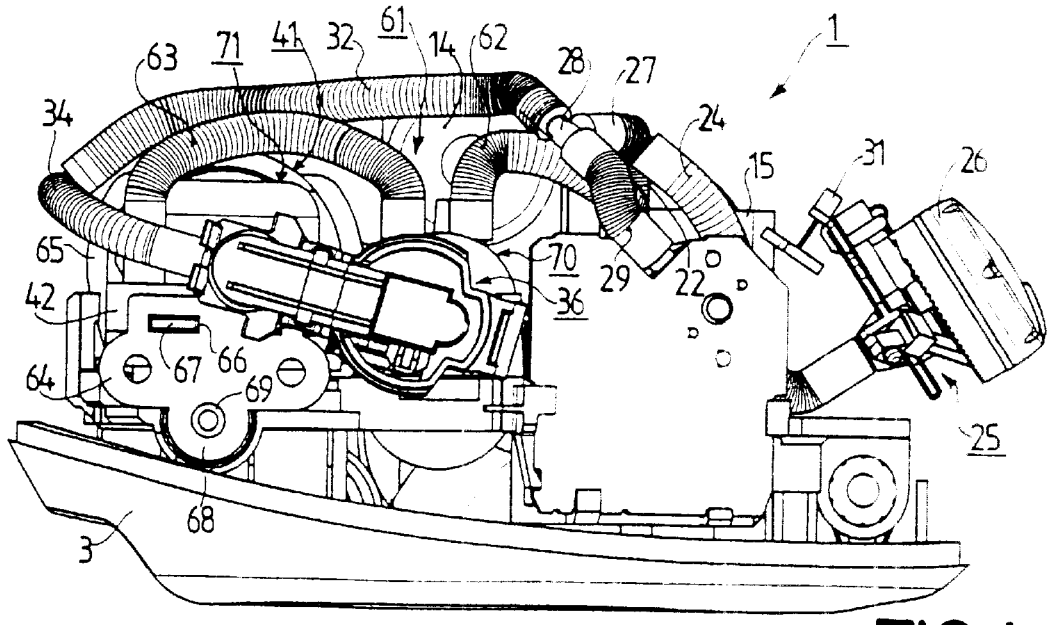
FIG. 4 shows the massaging apparatus of FIGS. 1 to 3 in a side view in which again only a lower housing part is shown and the other housing parts are not shown.

A first coupling portion 20 and a second coupling portion 21 are connected to the arcuate upper wall 18 of the suction chamber 17 in its top area, of which coupling portions only the first coupling portion 20 is visible in FIGS. 2 and 3.

A first length of tube 22 is connected to the first coupling portion 20 and leads to a first tee branch 23. A second length of tube 24 leads from the first tee branch 23 to a vacuum control device 25, which has a rotary knob 26 which can be turned to set a desired partial vacuum in the suction chamber 17. In addition, the massaging apparatus 1 can be switched on and switched off by means of the rotary knob 26.

A third length of tube 27 leads from the first tee branch 23 to a second tee branch 28. A fourth length of tube 29 leads from the second tee branch 28 to a vacuum switch 30 which, when a given partial vacuum is reached and sustained in the suction chamber 17, performs an electrical switching function, as a result of which a light-emitting diode (LED) 31 arranged in the area of the upper housing section 5 is caused to light up so as to obtain an indicator function which indicates that a given partial vacuum in the suction chamber 17 is reached.

Furthermore, a fifth length of tube 32 is connected to the second tee branch 28 and leads to a third tee branch 33. A sixth length of tube 34 and a seventh length of tube 35 are connected to the third tee branch 33. The sixth length of tube 34 is connected to a first vent switch 36. The seventh length of tube 35 is connected to a second vent switch 37. Each of the two vent switches 36 and 37 can be actuated by the thumb of a hand of a user, which first vent switch 36 and second vent switch 37 can be actuated simply, respectively, by the thumb of the right hand of a user and by the thumb of the left hand of a user in a recommended method of operating the massaging apparatus 1. By the actuation of one of the two vent switches 36 and 37 air is admitted to the suction chamber 17 either via the sixth length of tube 34 or the seventh length of tube 35 and the third tee branch 33 and the fifth length of tube 32 as well as the second tee branch 28 and the third length of tube 27 and the first tee branch 23 and the first length of tube 22 and the second coupling portion 21, thus enabling a previously prevailing partial vacuum to be cancelled abruptly.

Figure 5:
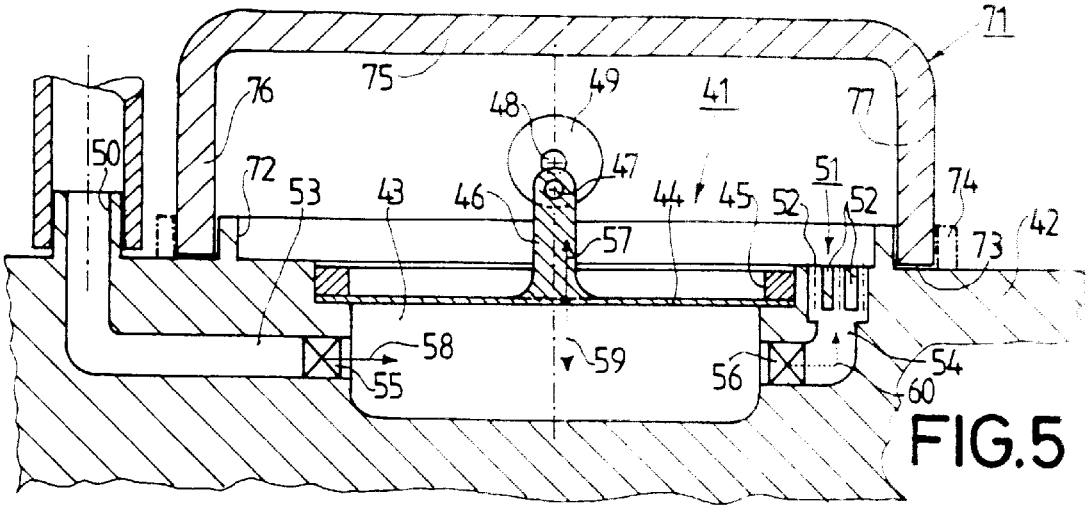
FIG. 5 diagrammatically shows a pump of the massaging apparatus of FIGS. 1 to 4.
Figure 6:
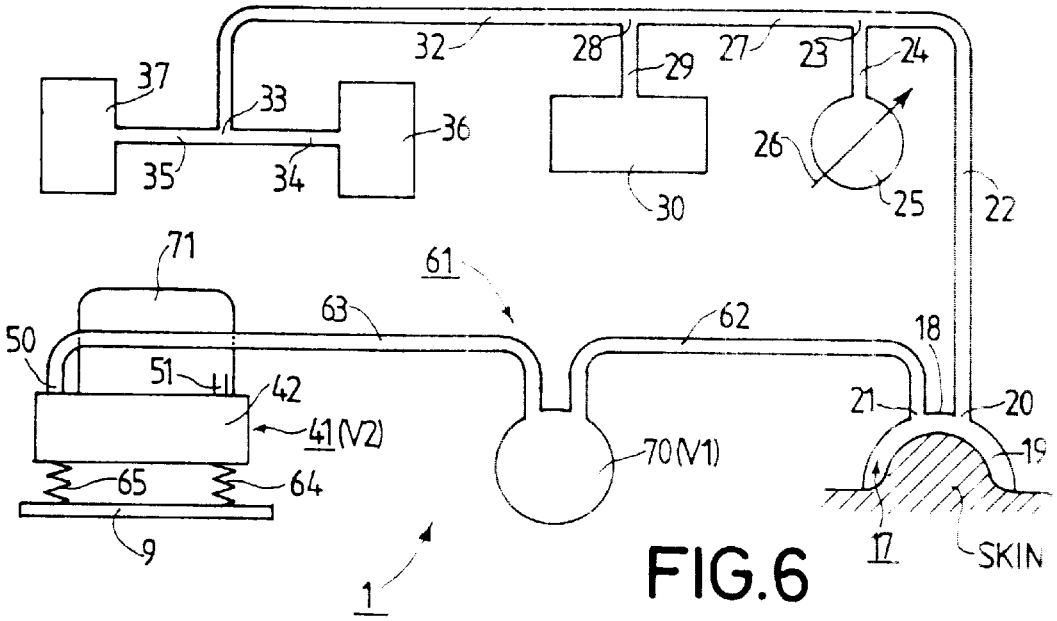
FIG. 6 diagrammatically shows the air-transfer ducts in the massaging apparatus of FIGS. 1 to 4 and the parts of the massaging apparatus of FIGS. 1 to 4 connected to the air-transfer ducts.

In order to enable a partial vacuum to be generated in the suction chamber 17 after the massaging apparatus 1 has been switched on, the massaging apparatus 1 includes a pump 41 mounted on the support 9. In the present case the pump is formed by a diaphragm pump, as can be seen in FIG. 5. The pump 41 has a pump housing 42 in which a pump space 43 has been provided. The pump 41 further has a diaphragm 44 which is capable of vibrating with respect to the pump space 43 and which is secured to the pump housing 42 by means of a mounting ring 45. In its central area the diaphragm 44 has a projecting portion 46 whose free end is coupled to an eccentric pin 47. The eccentric pin 47 projects from a disc 49 which is rotationally drivable about an axis 48. The disc 49 is rotationally drivable by means of a pump motor incorporated in the pump and not shown separately. The diaphragm 44 forms a cap-like sealing for the pump space 43 in the pump housing 42 in such a manner that no air can escape in the transitional area between the edges of the diaphragm 44 and the pump housing 42.

The pump 41 has an inlet 50 formed by a tubular inlet portion 50 connected to the pomp housing 42. The pump 41 further has an outlet 51 formed by a plurality of outlet apertures 52, of which three outlet apertures 52 are visible in FIG. 5. The inlet portion 50 communicates with the pump space 43 via a first pump channel 53. The outlet 51 communicates with the pump space 43 via a second pump channel 54. The first pump channel 53 includes a first pump valve 55 and the second pump channel 54 includes a second pump valve 56. The two valves 55 and 56 are of such a construction that in the case of an excursion of the diaphragm 44 in the direction indicated by the arrow 57 the first pump valve 55 is open and air is pumped from the inlet 50 into the pump space 43 in the direction indicated by the arrow 58 and the second pump valve 56 is closed. In the case of an excursion of the diaphragm 44 in a direction opposite to that indicated by the arrow 59 the first pump valve 58 is closed and the second pump valve is open, as a result of which air is pumped from the pump space 43 to the outlet 51 in the direction indicated by the arrow 60.

An air-transfer duct 61 connects the inlet 50 of the pump 41 to the suction chamber 17, i.e. to the second coupling portion 21 of the suction chamber 17. Thus, the inlet 50 serves for receiving the air pumped out of the suction chamber 17 by means of the pump 41. Likewise, the outlet 51 of the pump 41 serves for delivering air pumped out of the suction chamber 17 by means of the pump 41.

The air-transfer duct 61 includes an eighth length of tube 62 connected to the second coupling portion 21. The air-transfer duct 61 further includes a ninth length of tube 63 connected to the inlet 50 of the pump 41.

In the massaging apparatus 1 the pump 41 is advantageously secured to the support 9 by means of elastic mounts 64 and 65. In the present case two such elastic mounts 64 and 65 have been provided. It is to be noted that it is also possible to provide a one-piece elastic mount and that it is also possible to provide more than two elastic mounts for securing a pump of a massaging apparatus to a support of this massaging apparatus.

The first elastic mount 64 has a rectangular passage 66 which is engaged by a mounting limb 67 which projects from the pump housing 42. The elastic mount 64 further has a substantially semi-circular projection 68, which has a circular passage 69 through which a screw extends over substantially the whole width of the massaging apparatus 1 and which secures the first elastic mount 64 to the support.

The second elastic mount 65 is substantially ring-shaped and wholly surrounds the pump housing 42. The second elastic mount 65, like the first elastic mount 64, has a substantially semi-circular projection, the projection of the second elastic mount 65 also having a circular passage through which the afore-mentioned long screw extends, so that this long screw also secures the second elastic mount 65 to the support 9 in a reliable manner.

The massaging apparatus 1 advantageously further has first noise reduction means 70 disposed upstream of the inlet 50 of the pump 41 and included in the air-transfer duct 61 between the suction chamber 17 and the inlet 50. In the present case the first noise reduction means 70 are formed by a compensation vessel 70 included in the air-transfer duct 61 between the suction chamber 17 and the inlet 50 of the pump 41, which vessel is empty inside and encloses a compensation volume having a given volumetric content V1. The compensation vessel 70 is connected to the eighth length of tube 62 and the ninth length of tube 63 via two coupling portions.

In the massaging apparatus 1 the pump 41, which takes the form of a diaphragm pump, is adapted to pump in consecutive pumping cycles. It has proved to be very advantageous if the compensation vessel 70 encloses a compensation volume whose volumetric content V1 is a factor in a range between 10 and 30 as high as the air volume V2 pumped out of the suction chamber 17 in each pumping cycle. It has then proved to be particularly favorable if the compensation vessel 70 encloses a compensation volume whose volumetric content V1 is a factor of approximately 18 as high as the air volume V2 pumped out of the suction chamber 17 in each pumping cycle.

In a massaging apparatus 1 constructed in the course of its development it has proved to be advantageous to use a pump having a pumping capacity of 1200 $cm^3$/minute and a speed of 3600 r.p.m., so that in each pumping cycle an air volume of approximately ⅓ $cm^3$ of air is pumped out of the suction chamber 17, and to use a compensation vessel 70 which has a nominal compensation volume V1 of approximately 6.0 $cm^3$.

The massaging apparatus 1 advantageously further includes second noise reduction means 71 downstream of the outlet 51 of the pump 41. The second noise reduction means 71 are formed by a cover 71 connected to the pump 41, in the present case to the pump housing 42 of the pump 41. The outlet 51 of the pump opens into the cover 71 connected to the pump 41. The cover 71 guarantees a steady discharge of air from the interior of the cover into the atmosphere surrounding the cover 71. At its side which faces the pump housing 42 the cover 71 engages over the diaphragm 44 and is connected to the pump housing 42 in a manner not shown, a steady discharge of air being possible between the pump housing 42 and the cover 71. This steady discharge of air is achieved in that so much clearance has been provided between a rib 72 which projects from the pump housing 42 and the open end portion of the cover 71 and between the end faces 73 of the cover 71 and the pump housing 42 that a steady discharge of air from the interior of the cover is possible. Owing to the provision of the projecting rib 72 the noise produced by the diaphragm 44 is diverted, as a result of which the cover 71 provides a particularly satisfactory noise reduction.

In a variant of the massaging apparatus 1 as shown in FIG. 1 a further projecting rib 74 has been provided outside the cover 71, which results in an additional noise diversion and, consequently, a further noise reduction.

The cover 71 comprises cover walls 75, 76, 77 and 78 made of a noise-absorbing material. It has proved to be advantageous to make the cover walls 75, 76, 77 and 78 of polypropylene. It has further proved to be advantageous if the cover 71 comprises cover walls 75, 76, 77 and 78 whose wall thickness is in a range between 1.0 mm and 5.0 mm, a range between 3.5 mm and 4.0 mm having proved to be particularly advantageous.

As a result of the provision of two elastic mounts 64 and 65 and the first noise reduction means 70 as well as the second noise reduction means 71 in the massaging apparatus 1 the advantage is obtained that only a comparatively small amount of noise is produced and, consequently, a massaging apparatus 1 is obtained which produces noise of a level which users consider to be hardly annoying.

In a massaging apparatus in accordance with the invention the first noise reduction means may alternatively be formed by a compensation vessel which contains a sound-absorbing material. In a massaging apparatus in accordance with the invention the second noise reduction means may also be formed by a compensation vessel which contains a sound-absorbing material. In a massaging apparatus in accordance with the invention the pump may alternatively be a piston pump.

What is claimed:

1. A massaging apparatus comprising a housing, a support accommodated in the housing, a suction chamber in said housing, a pump mounted on the support, for pumping air out of the suction chamber, and comprising an inlet for receiving the air pumped out of the suction chamber by the pump and an outlet for discharging the air pumped out of the suction chamber, an air-transfer duct connecting the inlet to the suction chamber, wherein the pump is mounted on the support by elastic mounts, a first noise reduction means arranged upstream of the inlet and positioned in the air-transfer duct and a second noise reduction means arranged downstream of the outlet.

2. A massaging apparatus as claimed in claim 1, wherein the first noise reduction means are formed by a compensation vessel included in the air-transfer duct between the suction chamber and the inlet of the pump, which vessel is empty inside and encloses a compensation volume having a given volumetric content (V1).

3. A massaging apparatus as claimed in claim 2, wherein the pump is adapted to pump in consecutive pumping cycles, and the compensation vessel encloses a compensation volume whose volumetric content (V1) is a factor in a range between 10 and 30 as high as the air volume (V2) pumped out of the suction chamber in each pumping cycle.

4. A massaging apparatus as claimed in claim 3, wherein the compensation vessel encloses a compensation volume whose volumetric content (V1) is a factor of approximately 18 as high as the air volume (V2) pumped out of the suction chamber in each pumping cycle.

5. A massaging apparatus as claimed in claim 1, wherein the second noise reduction means comprises a cover connected to the pump, the outlet opening into the cover and ensuring a steady discharge of air from the interior of the cover into the atmosphere surrounding the cover.

6. A massaging apparatus as claimed in claim 5, wherein the cover comprises cover walls whose wall thickness is in a range between 1.0 mm and 5.0 mm.

7. A massaging apparatus as claimed in claim 6, wherein the cover walls have a wall thickness in a range between 3.5 mm and 4.0 mm.

8. A massaging apparatus as claimed in claim 5 wherein the cover comprises cover walls made of a sound-absorbing material.

9. A massaging apparatus as claimed in claim 8, wherein the cover walls are made of polypropylene.

10. A massaging apparatus as claimed in claim 5 wherein the pump comprises a diaphragm capable of vibrating with respect to a pump space in a pump housing for the pump, the diaphragm forming a sealing cap for the pump space in the pump housing and the cover engaged over the diaphragm and connected to the pump housing.

* * * * *